US005377361A

United States Patent [19]

Piskula

[11] Patent Number: 5,377,361

[45] Date of Patent: Jan. 3, 1995

[54] TOILET FLANGE

[76] Inventor: James Piskula, P.O. Box 26174, Milwaukee, Wis. 53226

[21] Appl. No.: 253,644

[22] Filed: Jun. 3, 1994

[51] Int. Cl.[6] ..... E03D 11/16

[52] U.S. Cl. ..... 4/252.4; 4/252.1; 138/90

[58] Field of Search ..... 4/293, 295, 252.1, 252.4, 4/252.5, 252.6; 138/89, 90, 92; 73/46, 49.1, 49.5, 49.8

[56] References Cited

U.S. PATENT DOCUMENTS

| | | | |
|---|---|---|---|
| 2,596,182 | 5/1952 | Sosaya | 138/89 |
| 4,052,759 | 10/1977 | Hill | 4/252 R |
| 4,146,939 | 4/1979 | Izzi | 4/286 |
| 4,423,526 | 1/1984 | Izzi, Sr. | 4/252 R |
| 4,542,642 | 9/1985 | Tagliarino | 138/90 |
| 4,602,504 | 7/1986 | Barber | 138/89 |
| 4,763,510 | 8/1988 | Palmer | 138/90 |
| 4,780,915 | 11/1988 | Cuschera | 4/252 R |
| 4,823,411 | 4/1989 | Nettel | 4/255 |
| 4,827,539 | 5/1989 | Kiziah | 4/252 R |
| 4,936,350 | 6/1990 | Huber | 138/90 |
| 5,033,510 | 7/1991 | Huber | 138/90 |
| 5,115,554 | 5/1992 | Fell, Sr. | 4/252.4 |
| 5,163,480 | 11/1992 | Huber | 138/89 |

*Primary Examiner*—Henry J. Recla
*Assistant Examiner*—Charles R. Eloshway
*Attorney, Agent, or Firm*—Quarles & Brady

[57] ABSTRACT

A toilet flange is disclosed for mounting a toilet to a floor and for connecting the toilet to a drain pipe leading to a sewer pipe. The toilet flange has an axial bore which is initially closed at the top by an integral knock out element which seals the bore for air or water testing prior to the installation of the toilet. The knock out element when removed is larger than the lumen of the drain pipe so that it cannot fall into it.

4 Claims, 2 Drawing Sheets

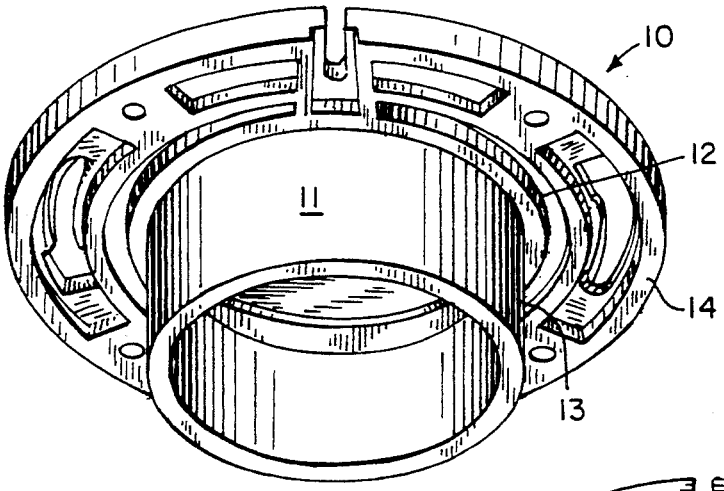
FIG. 1
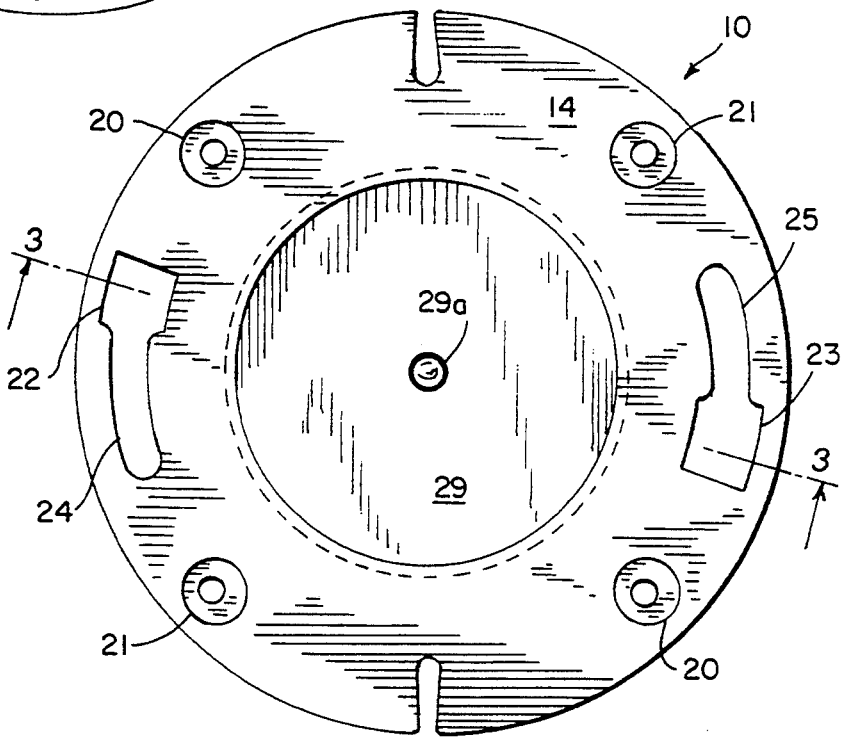
FIG. 2
FIG. 3
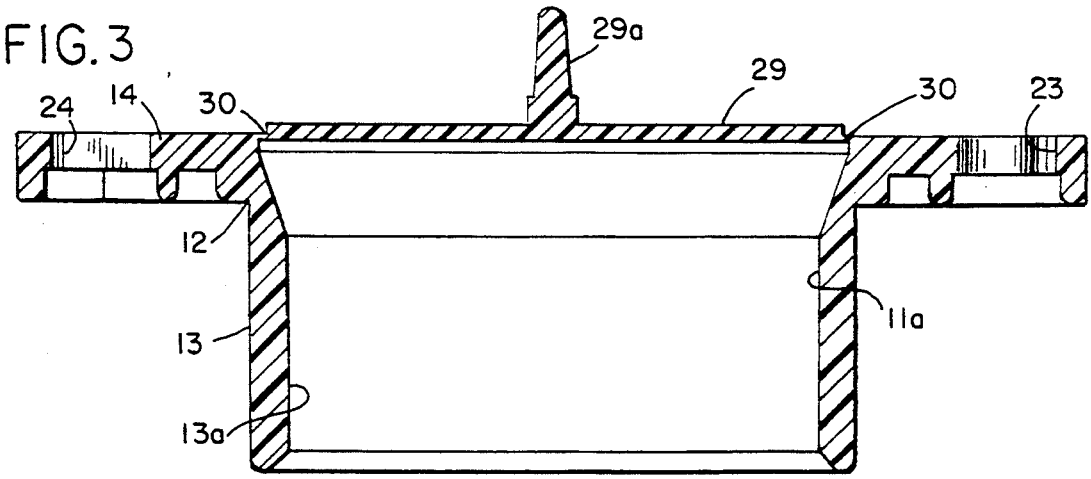

FIG. 4
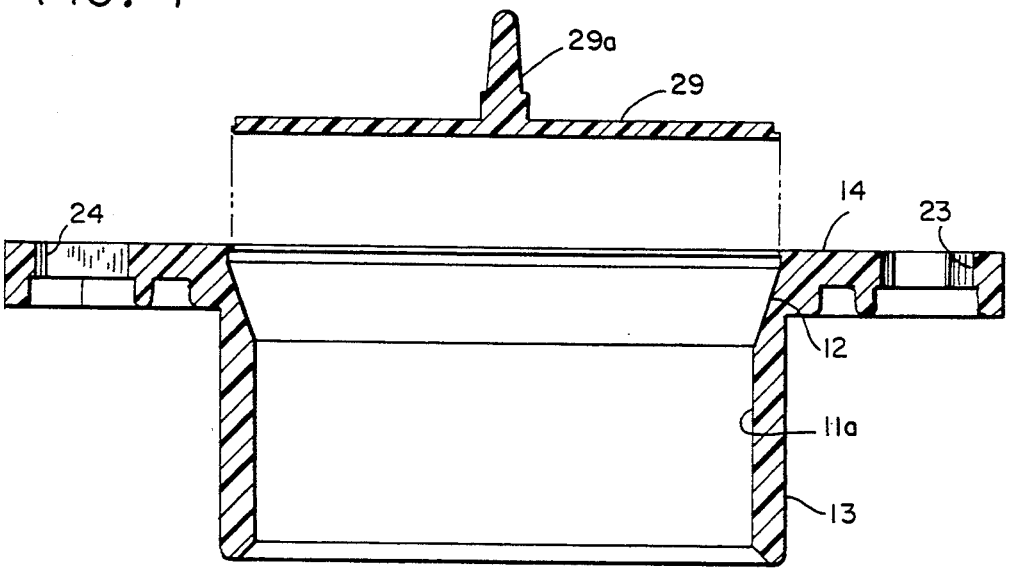
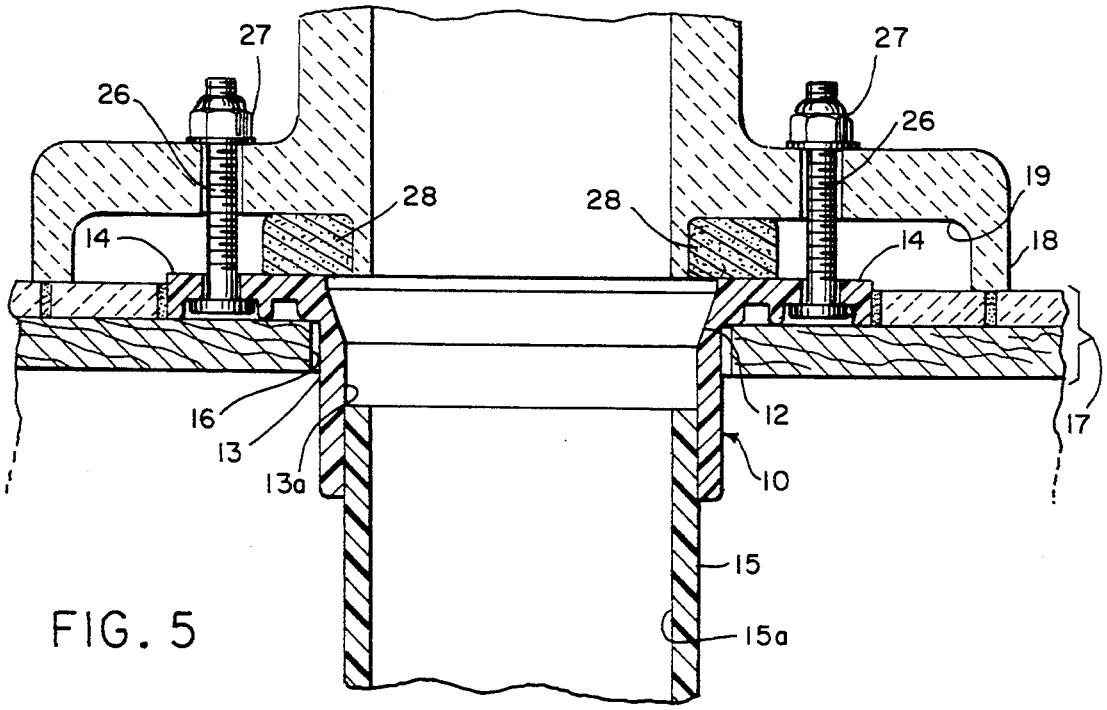
FIG. 5

TOILET FLANGE

FIELD OF THE INVENTION

The invention relates to a toilet flange. More particularly it relates to a toilet flange having its top closed with a "knock out" element which can be readily removed after air or water testing.

BACKGROUND OF THE INVENTION

A conventional toilet, when installed, is bolted to a flange which is in turn attached to the floor. The flange, which is commonly referred to as a "closet" or "toilet" flange, serves as a means for mounting the toilet and connecting the toilet to a drain pipe which leads to a sewer pipe.

It is usually required during construction to perform an air test or a water test of the plumbing to ensure that the pipes, fittings and the like are properly connected and don't leak. Although the pressures used in such testing are relatively low, the various means used in the past to seal the open tops of the most widely used prior art toilet flanges could be "blown-out" thus requiring resealing and retesting.

It is now common to make plumbing piping, such as drain pipe, and fittings, such as elbows, toilet flanges, and the like, of plastic materials, such as acrylonitrile-butadiene-styrene (ABS) or polyvinylchloride (PVC).

One type of prior art toilet flange which is molded of plastic has an integral knock out element which is positioned below the top of the inlet end of the flange immediately above the drain pipe connection. The knock out element closes off flow from the drain pipe through the flange and enables the water and air tests to be conducted with the flange in place. However, this flange had a distinct disadvantage. Once the air or water tests are conducted, and the knock out element is removed by a blow or blows of a hammer, the knock out element which is smaller than the lumen of the drain pipe can fall down into the drain pipe causing problems.

It would be advantageous to have a molded plastic toilet flange that did not possess the disadvantages of prior art flanges.

SUMMARY OF THE INVENTION

It is an object of the present invention to disclose a molded plastic toilet flange which has an integral knock out element which when it is removed cannot fall into the drain pipe.

In the toilet flange of the present invention, this object is achieved by providing a knock out element at the top of the inlet end of the flange. The knock out element is larger than the drain pipe to which the flange is connected.

The toilet flange of the present invention provides a number of advantages over the prior art flanges. First of all, once the toilet flange of the present invention is installed, the air or water testing can be completed without having to first seal the inlet of the flange as must he done with the most widely used prior art flanges. Second, because the knock out element is an integral part of the flange it provides a more economical approach than prior art flanges having a separate screw-in plug. And third, the knock out element which is larger than the drain pipe can't fall down into the drain pipe.

In one preferred embodiment of the invention the toilet flange comprises a cylindrical main body with an axial bore. The body has an upper cylindrical body portion which connects to the toilet and a lower cylindrical body portion which connects to a drain pipe. The upper body portion is larger in diameter than the lower body portion, and it defines the inlet of the bore. The main body also includes a conventional annular, outwardly extending attachment flange about the top of the upper body portion. The attachment flange is used to attach the toilet flange to a floor with the lower body portion of the main body extending through an aperture in the floor to the drain pipe. The top of the axial bore is initially closed by an integral knock out element which seals the bore for air or water testing prior to the mounting of the toilet. The knock out element, which can be cut out or removed by blows with a hammer; is larger than the lumens of both the lower body portion and the drain pipe so that it cannot fall into them.

In an especially preferred embodiment, the knock out element is connected to the rest of the top of the upper body portion by a relatively thin web of material and the entire toilet flange including the integral knock out element is a unitary member molded of a plastic, such as ABS or PVC.

BRIEF DESCRIPTION OF THE DRAWINGS

In the drawings:

FIG. 1 is a perspective view of a preferred embodiment of the toilet flange of the present invention;

FIG. 2 is a top view of the toilet flange of FIG. 1;

FIG. 3 is a sectional view taken along lines 3—3 in FIG. 2;

FIG. 4 is a view showing the knock out element of the toilet flange of FIG. 1 removed and positioned above the main body of the flange; and FIG. 5 is a sectional view showing the flange of FIG. 1 attached to a toilet and a floor.

DETAILED DESCRIPTION OF A PREFERRED EMBODIMENT

Referring to FIGS. 1 to 4 of the drawings, a toilet floor flange 10 of the present invention has a cylindrical main body 11, having a relatively large diameter upper body portion 12, and a relatively smaller diameter lower body portion 13. The main body 11 also has an essentially flat annular outwardly extending attachment flange 14. The preferred toilet flange 10 is molded of appropriate plastic material, such as the aforementioned ABS or PVC, using a collapsible mold.

As seen in FIG. 5, the lower body portion 13 is proportioned to make a female connection with the upper end of a drain pipe 15 that extends up into an opening 16 in a floor 17 beneath a toilet base 18. The toilet base 18 gas a concavity 19 which extends downwardly to receive the attachment flange 14 and to support the weight of the toilet.

The attachment flange 14 of the preferred embodiment is conventional and well known. It is common practice to provide such an attachment flange 14 with at least one, and generally two pairs of diametrically opposed countersunk holes 20—20 and 21—21 which are used with screws to attach the flange 14 to the floor 17. The attachment flange 14 also is provided with a pair of radially inwardly extending, diametrically opposed, undercut notches 22 and 23 and a pair of identical, arcuate, undercut slots 24 and 25. As seen in FIG. 5, the notches 22 and 23, and slots 24 and 25 are used with bolts 26 and nuts 27 to fasten the toilet base 18 to the flange 14.

Referring to FIG. 4, it can be seen that an axial bore 11*a* extends throughout the main body 11. It can be seen in FIG. 5 that the upper body portion 11 defines the inlet end of the bore 11*a* and that it is provided with the annular attachment flange 14 which is attached to the floor 17. The lower body portion 13 has a smaller interior and exterior diameter than the upper body portion 12 and it defines the exit end of the bore 11*a*.

As seen in FIG. 5, the lower body portion 13 of the toilet flange 10 extends through an opening 16 in the floor 17 and receives the upper end of a drain pipe 15. The lower body portion 13 is operatively connected to the upper end of drain pipe 15 by appropriate adhesive or other means, as is well-known in the art. A male version of the toilet flange (not shown) in which the lower body portion enters into the drain pipe is used in similar manner. To install a toilet, it is necessary to provide a seal between the toilet and the drain pipe 15. This is conventionally accomplished by the provision of a wax ring 28.

As described thus far, the toilet flange 10 of the present invention has substantially all of the features of the prior art flanges. The improvement constituting the present invention resides in the integral knock out element 29 which, as seen in FIGS. 1, 2 and 3, initially closes the inlet end of the axial bore 11*a* at the top of the toilet flange 10.

When the toilet flange 10 is properly installed, and the air or water testing of the plumbing system is complete, all that is needed to open the inlet of the bore 11*a* is to remove the knock out element 29 as shown in FIG. 4 by either cutting it out or knocking it out by hammer blows. The toilet can then be attached to the floor 17 via the attachment flange 14 as described.

As can be seen best in FIG. 1 and FIG. 2, the knock out element 29 is defined and connected to the remainder of the top 10*a* of the toilet flange 10 by an annular web 30 which is relatively thinner and weaker than the knock out element 29 and the remainder of the top 10*a*. As can be seen in FIG. 4 the knock out element 29 when removed is larger in diameter than the lumen 13*a* of the lower body portion 13. It also is larger than the lumen 15*a* of the drain pipe 15. Therefore, the knock out element 29 when it is removed from the rest of the top 10*a* is too large to fall into the lumen 13*a* or the lumen 15*a* and to cause problems. To facilitate the handling of the knock out element 29, it can be provided with a handle 29*a*.

From the foregoing, it will be apparent that the toilet flange of the present invention is an improvement upon the prior art flanges and that its use can save a plumber both time and money. Furthermore, air or water testing can be practiced without fear of blow-out. It will be apparent that modifications may be made to the toilet flange without departing from the spirit of the present invention. Therefore, it is intended that the invention should be limited only by the claims.

I claim:

1. A toilet flange for mounting a toilet to a floor and for connecting said toilet to a drain pipe leading to a sewer pipe, said toilet flange comprising a cylindrical main body with an axial bore with a closed top and open bottom, said main body having upper and lower cylindrical body portions, said lower body portion being connectable to said drain pipe, said upper portion being larger in diameter than said lower body portion and defining an inlet of said body, an exterior annular attachment flange located about said inlet for attachment to a floor with said body extending through an aperture in said floor and for attachment to said toilet thereto, said axial bore being closed at a top thereof by an integral knock out element which seals the bore for air or water testing prior to the mounting of said toilet and which is larger in diameter than the lower body portion so that it cannot enter therein when removed from the top.

2. A toilet flange of claim 1 in which the knockout element is connected to the top by a relatively thin web of material.

3. A toilet flange of claim 1 in which the entire toilet flange including the integral knock out element is a unitary member molded of plastic.

4. A toilet flange of claim 1 in which the integral knock out element is provided with a handle.

* * * * *